US011542079B2

(12) United States Patent
Bates et al.

(10) Patent No.: US 11,542,079 B2
(45) Date of Patent: Jan. 3, 2023

(54) PACKAGING FOR RETRACTABLE HAND TOOL

(71) Applicant: Stanley Black & Decker, Inc., New Britain, CT (US)

(72) Inventors: Alexander Bates, Portland, CT (US); Jonathan Miller, Burlington, CT (US)

(73) Assignee: Stanley Black & Decker, Inc., New Britain, CT (US)

( * ) Notice: Subject to any disclaimer, the term of this patent is extended or adjusted under 35 U.S.C. 154(b) by 0 days.

(21) Appl. No.: 17/521,341

(22) Filed: Nov. 8, 2021

(65) Prior Publication Data

US 2022/0055813 A1 Feb. 24, 2022

Related U.S. Application Data

(62) Division of application No. 16/531,702, filed on Aug. 5, 2019, now Pat. No. 11,198,548.

(51) Int. Cl.
*B65D 73/00* (2006.01)
*B26B 5/00* (2006.01)

(52) U.S. Cl.
CPC ..... *B65D 73/0021* (2013.01); *B26B 5/003* (2013.01)

(58) Field of Classification Search
CPC .. B65D 73/0021; B65D 73/0042; B65B 5/003
USPC ..... 206/349, 495, 493
See application file for complete search history.

(56) References Cited

U.S. PATENT DOCUMENTS 3,674,138 A * 7/1972 Gilmour ..... B65D 73/0014 206/349
3,891,088 A * 6/1975 Huebner ..... B65D 75/366 206/349
4,354,598 A * 10/1982 Schillinger ..... B65D 73/0085 206/476
4,456,124 A * 6/1984 Kay ..... B65D 73/0057 206/463
4,650,074 A * 3/1987 Vosbikian ..... B65D 73/0064 206/349
4,714,159 A * 12/1987 Linden ..... B65D 73/0057 206/349
4,749,082 A * 6/1988 Gardiner ..... B65D 75/32 206/349
5,477,964 A * 12/1995 Hart ..... B65D 73/0021 206/483
5,509,532 A * 4/1996 Brody ..... B65D 73/0064 206/349

(Continued)

*Primary Examiner* — Jacob K Ackun
(74) *Attorney, Agent, or Firm* — Gabriel A. Haboubi

(57) ABSTRACT

A packaging card for a tool comprising a fixed member and a movable member that is selectively movable relative to the fixed member includes a tool engaging region coupling the packaging card to the movable member such that movement of the movable member relative to the fixed member moves the card relative to the fixed member. The card also includes a deformation region that tears or deforms upon application of a separation force sufficient to remove the packaging card from the tool. Another packaging card for a tool having a housing with front and side apertures includes a front flange receivable in the front aperture of the tool, a side flange (Continued)

insertable into the side aperture, and a hook catchable on an interior of the housing to deter removal of the packaging card from the tool until sufficient force is applied to overcome a holding power of the hook.

14 Claims, 9 Drawing Sheets

(56) References Cited

U.S. PATENT DOCUMENTS 6,202,842 B1 * 3/2001 Pirro ..... B65D 73/0064 206/349
6,401,924 B1 * 6/2002 Fresnel ..... B65D 75/002 206/466
6,681,932 B2 * 1/2004 Bradfield ..... B65D 73/0064 206/349
6,732,989 B1 * 5/2004 Kao ..... A47F 5/0006 206/349
7,070,049 B2 * 7/2006 Lee ..... B65D 73/00 206/349
7,360,651 B2 * 4/2008 Kuo ..... B65D 73/0064 206/376
7,424,951 B2 * 9/2008 Hu ..... B65D 73/0042 206/349
8,322,531 B2 * 12/2012 Miller ..... B65D 73/005 206/553
8,479,916 B2 * 7/2013 Williams ..... B65D 73/0092 206/349
11,198,548 B2 * 12/2021 Bates ..... B65D 73/0021
11,203,476 B2 * 12/2021 Zacherle ..... B65D 73/0014
2003/0159956 A1 * 8/2003 Woos ..... B65D 85/24 206/338
2008/0190796 A1 * 8/2008 Clark ..... B65D 73/0014 206/349
2009/0288971 A1 * 11/2009 Webb ..... B65D 73/0014 206/354
2011/0272309 A1 * 11/2011 Miller ..... B65D 73/005 206/349
2011/0297568 A1 * 12/2011 Miller ..... B65D 73/0014 206/349
2013/0043156 A1 * 2/2013 Glass ..... B65D 73/0028 248/317
2016/0096670 A1 * 4/2016 Farland ..... B65D 67/00 206/349
2018/0099622 A1 * 4/2018 Richardson ..... B65D 73/0064
2019/0009962 A1 * 1/2019 Pruitt, II ..... B65D 73/0014

* cited by examiner

PACKAGING FOR RETRACTABLE HAND TOOL

RELATED APPLICATIONS

This application is a Divisional of U.S. patent application Ser. No. 16/531,702, filed Aug. 5, 2019, the disclosure of which is incorporated herein by reference in its entirety.

FIELD OF THE INVENTION

The present invention relates generally to packaging for retractable hand tools, and in the illustrated embodiment packaging for retractable utility knives.

BACKGROUND OF THE INVENTION

Certain hand tools include operating ends that selectively extend from or retract into a housing body, such as a handle. At point of sale or point of purchase, it may be desirable for consumers to test out the functionality of such retraction features, without removing the hand tool from the packaging that includes branding, features and benefits, safety information, UPC codes, and other such materials. It may also be desirable for packaging to be configured to be mounted to product after quality control has validated the product.

Among other things, the present application relates to improvements to packaging material for such hand tools to facilitate testing out of a retraction feature.

SUMMARY OF THE INVENTION

According to an embodiment, a packaging card for a tool, wherein the tool comprises a fixed member and a movable member such that the movable member is selectively movable relative to the fixed member, includes a tool engaging region coupling the packaging card to the movable member such that movement of the movable member relative to the fixed member moves the packaging card relative to the fixed member. The packaging card also includes a deformation region configured to tear or deform upon application of a separation force sufficient to remove the packaging card from the tool.

According to another embodiment, a packaging card for a tool, wherein the tool comprises a housing having a front aperture and a side aperture, includes a front flange configured to be received in the front aperture of the tool, a side flange configured to be inserted into the side aperture of the tool, and a hook inserted into the housing configured to catch on an interior of the housing to deter removal of the packaging card from the tool until sufficient force is applied to overcome a holding power of the hook.

The objects, features, and characteristics of the present invention, as well as the methods of operation and functions of the related elements of structure and the combination of parts and economies of manufacture, will become more apparent upon consideration of the following description with reference to the accompanying drawings, all of which form a part of this specification, wherein like reference numerals designate corresponding parts in the various figures. In one embodiment of the invention, the structural components illustrated herein are drawn to scale. It is to be expressly understood, however, that the drawings are for the purpose of illustration and description only, and are not intended as a definition of the limits of the invention. In addition, it should be appreciated that structural features shown or described in any one embodiment herein can be used in other embodiments as well. As used herein, the singular form of "a", "an", and "the" include plural referents unless the context clearly dictates otherwise.

BRIEF DESCRIPTION OF THE DRAWINGS

Features of packaging in accordance with one or more embodiments are shown in the drawings, in which like reference numerals designate like elements. The drawings form part of this original disclosure in which.

DESCRIPTION OF THE ILLUSTRATED EMBODIMENT(S)

Figure 1:
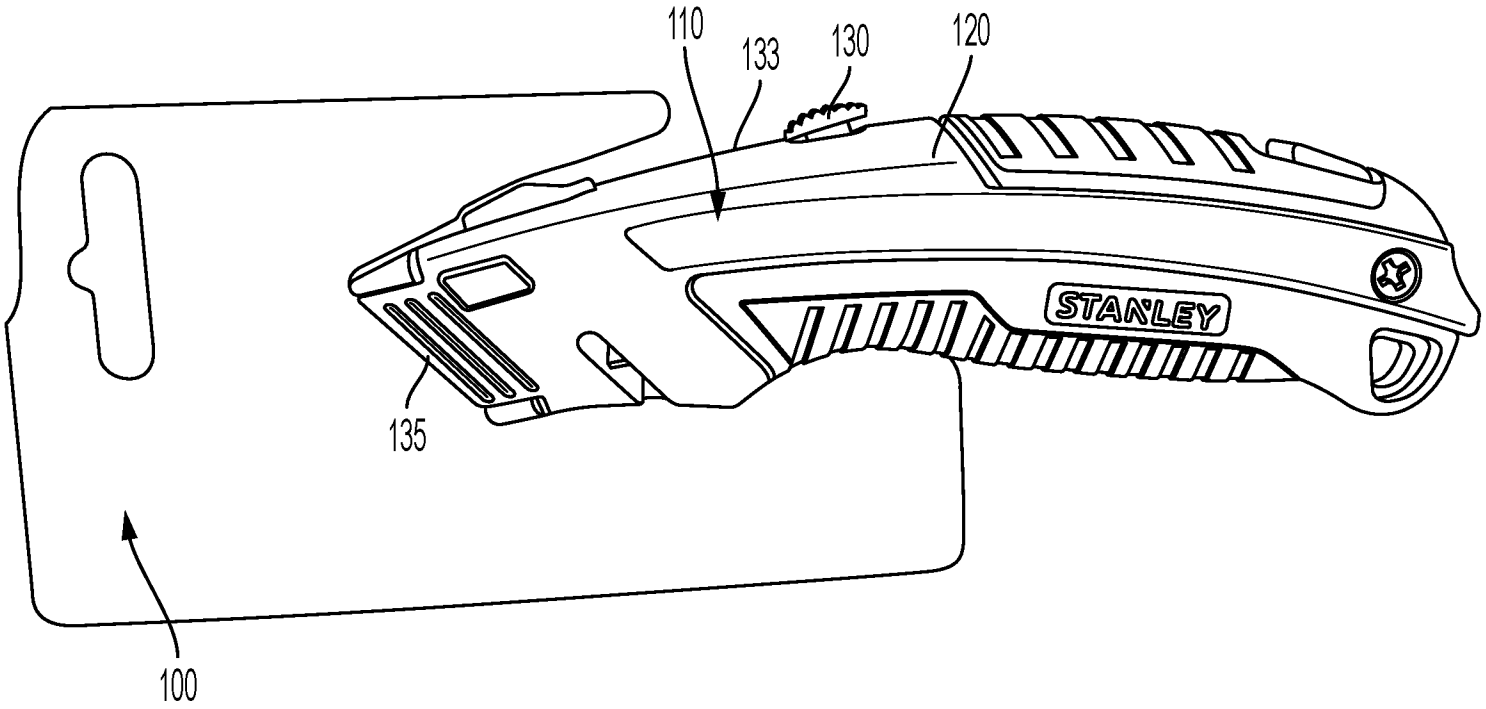
FIG. 1 illustrates a top view of an embodiment of a packaging card in combination with a retractable utility knife mounted thereto according to an aspect of the present disclosure, where the packaging card is positioned relative to the retractable utility knife when the retractable utility knife is in a retracted position.
Figure 2:
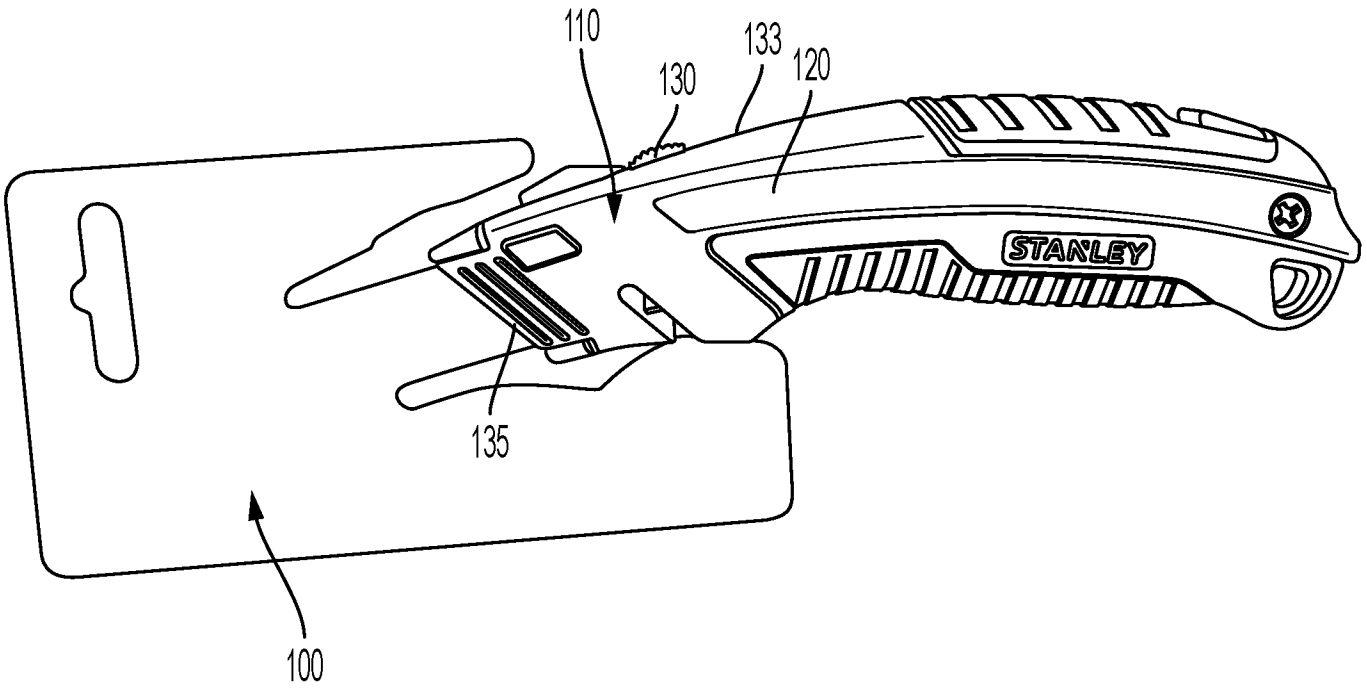
FIG. 2 illustrates a top view of the packaging card in combination with the retractable utility knife of FIG. 1, however having the packaging card positioned relative to the retractable utility knife when the retractable utility knife is in an extended position.

As shown in FIGS. 1 and 2, in an embodiment a packaging card 100 may be configured to receive a retractable tool such as retractable utility knife 110 which includes a fixed member such as handle 120 and a movable member such as the slidable blade carriage (obscured in FIGS. 1 and 2 but itself fixed relative to an actuator 130, such as but not limited to a button or protrusion). As described in greater detail below, the packaging card 100 may be fixed relative to the movable member, such that the packaging card 100 is itself movable relative to the fixed member (e.g., the handle 120 in the illustrated embodiment) when the movable member of the retractable tool is actuated (e.g. through extension or retraction of the actuator 130 along a channel or other aperture formed in the tool, such as actuator channel 133). As shown, it may be appreciated that the packaging card 100 may extend into a front aperture of the tool (e.g., a blade aperture 135 at the front of utility knife 110, through which the utility knife blade conventionally extends from or retracts into).

In FIG. 1, the packaging card 100 and utility knife 110 are shown such that the sliding blade carriage is in a retracted position, and as such the packaging card 100 is retracted relative to the utility knife 110. As shown in FIG. 2, however, and as discussed in greater detail below, the packaging card 100 may extend relative to the fixed member of the utility knife 110 (e.g. the handle 120), such that consumer trial of the retraction feature of the retractable tool may be demonstrated prior to purchase at point of sale or point of purchase. It may be appreciated that the packaging card 100 may itself be formed from a generally flexible material, such as one or more of paper stock, card stock, cardboard, thin plastic, or combinations thereof (e.g., polyethene coated paper board). Accordingly, it may be appreciated that a user at point of sale or point of purchase may flex the packaging card 100 away from the fixed member of the tool (e.g., the handle 120 of the knife 110), and utilize the actuator 130 to move the movable member to extend the packaging card 100 away from the tool and/or retract the movable member, and thus the packaging card 100, back towards the tool, so as to test the extension and retraction functionality of the tool. It may be appreciated that such ability to try the extension and retraction functionality of the tool may prompt the user to decide to purchase the tool based on satisfaction of the functionality.

Figure 3:
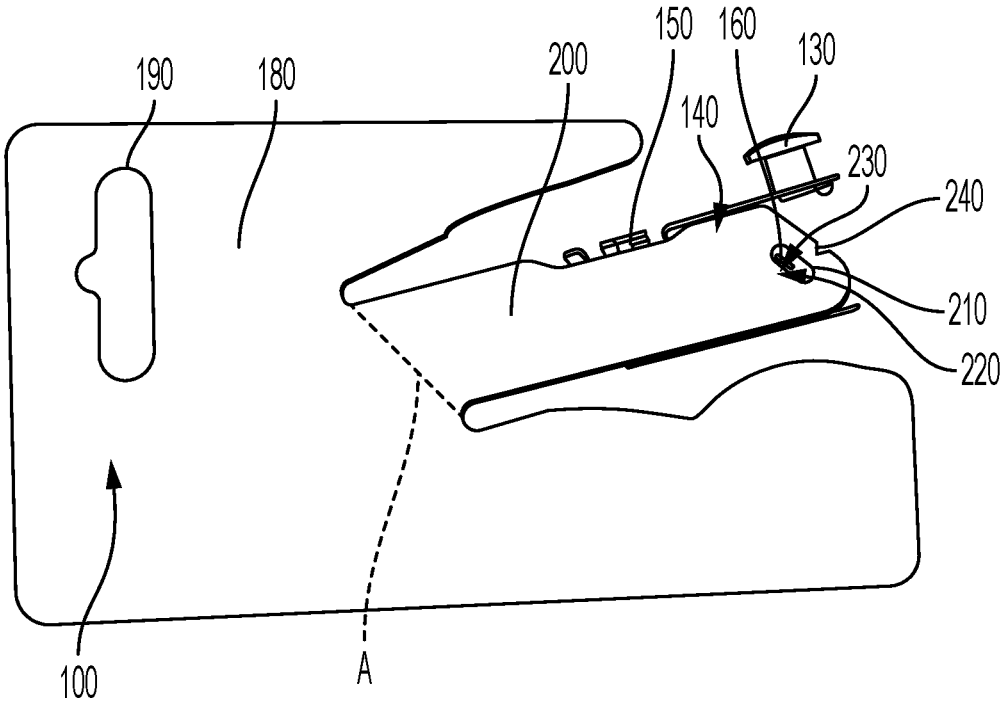
FIG. 3 illustrates a top view of the packaging card of FIG. 1, however with all but a sliding blade holder of the retractable utility knife omitted so as to show engagement between the packaging card and the sliding blade holder in a way that secures the packaging card to the retractable utility knife.
Figure 4:
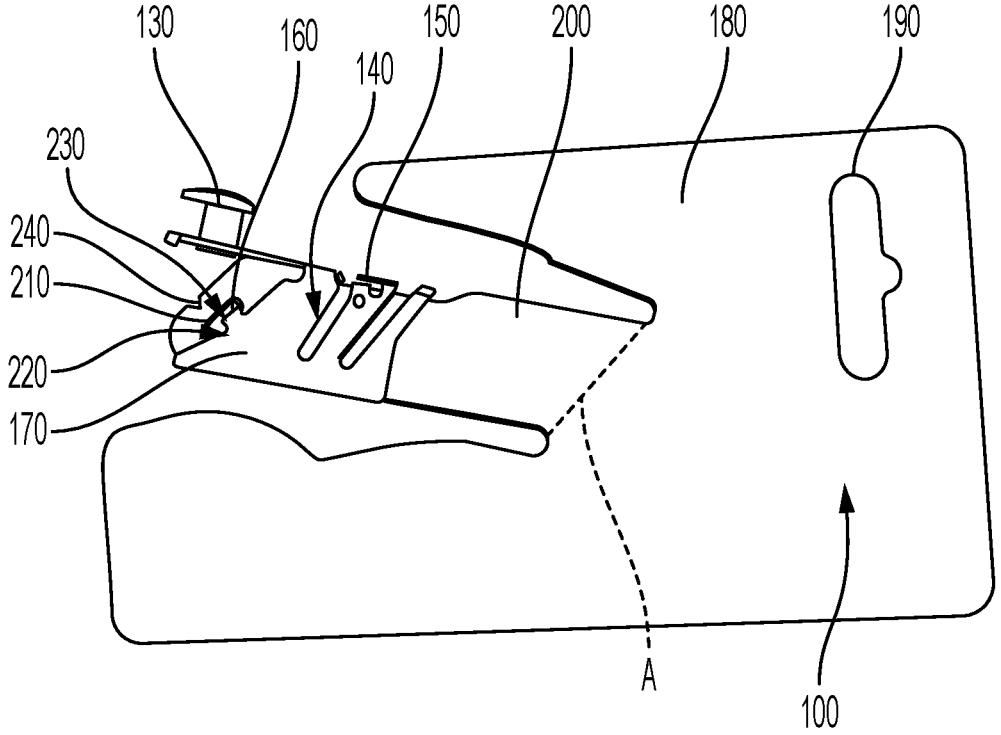
FIG. 4 illustrates a bottom view of the packaging card and the sliding blade holder as otherwise depicted in FIG. 3.

FIGS. 3 and 4 illustrate the packaging card 100 more clearly, as the bulk of the utility knife 110 is omitted, showing engagement of the packaging card 100 with a movable member of the tool, such as slidable blade carriage 140 (including the actuator 130) of the knife 110. As shown, in the illustrated embodiment, the slidable blade carriage 140 includes the actuator 130 fixed thereto (so as to protrude out of the handle 120 of the knife 110), and contains a notch engaging protrusion 150 normally configured to engage notches on a conventional utility knife blade (e.g., a trapezoidal blade with "mouse bite" notches). The slidable blade carriage 140 also includes a rear blade support 160 which is conventionally angled to engage a side of the conventionally trapezoidal utility knife blade, assisting in seating the blade such that the notch engaging protrusion 150 of the blade carriage 140 is aligned to be positioned within the notch of the trapezoidal blade, locking the blade relative to the blade carriage 140.

As further shown in FIG. 4, which illustrates the rear of the packaging card 100 and the rear of the slidable blade carriage 140, the various components of the slidable blade carriage 140 may be coupled by a planar carriage body 170, which may be formed of spring steel, a cast part, or other such configurations in various embodiments so that the notch engaging protrusion 150 may be flexed relative to the remainder of the carriage 140 to release a blade when desired.

Taking a closer look at features of the packaging card 100 as depicted in the embodiment of FIG. 3, it may be appreciated that the packaging card 100 may comprise a body 180 which may include printed thereon (e.g. on one or opposing faces thereof) marketing information such as branding, product features and benefits, contact information, barcode information, pricing, or other such material normally provided to consumers and salespeople at point of sale or point of purchase. As shown, in some embodiments the body 180 may extend to surround where the tool (e.g., the knife 120) is mounted, and may provide further information thereon. It may be appreciated, as noted above, that in some embodiments some or all of the body 180 may be flexible, and in particular in some embodiments there may be flexibility in regions surrounding user engageable aspects of the tool (e.g., the handle 120 or the actuator 130), so that such regions of the body 180 may be flexed away from the hand of the user so that the user can flex the packaging card 100 out of the way to engage those or similar regions so as to demonstrate the extension and retraction functionality.

In an embodiment, the body 180 may include therein a hang tag aperture 190, which may facilitate hanging the packaging card 100 and the tool (e.g., utility knife 110) from a peg board or other point of sale or point of purchase displays. In other embodiments, a hang tag engagement region may be attached (e.g., adhered) to the body 180 so as to protrude outward and facilitate hanging the packaging card 100 and the tool 110.

As shown, in an embodiment extending from the body 180 may be a tool engaging region 200 (generally indicated as being separated by the dashed line A in the illustrated embodiment) that is configured to be mounted to the movable member of the tool (e.g., the slidable blade carriage 140 of the knife 110 in the illustrated embodiment). As shown, the tool engaging region 200 of the packaging card 100 may include a surface 210 configured to engage a feature of the movable member of the tool in a way that prevents easily disengaging the packaging card 100 from tools such as the knife 110. For example, where the tool is a retractable utility knife, the surface 210 may be part of an aperture 220 formed in the tool engaging region 200, which may surround a portion of the movable member (e.g., the rear blade support 160 of the slidable blade carriage 140 in the illustrated embodiment).

It may be appreciated that by at least partially surrounding a feature of the movable member, separation of the packaging card 100 from the tool may require pulling the packaging card 100 relative to the tool with sufficient force so as to deform or break the packaging card 100 at a deformation region 230 of the tool engaging region 200 such that the tool may be separated from the packaging card 100. It may be appreciated that in some embodiments the separation force may be such that is applicable by a conventional user, but greater than that which would be applied when the tool is hanging by the hang tag aperture 190, or greater than that which would normally be applied to the tool engaging region 200 when the extension or retraction functionality of the tool is being repeatedly demonstrated by users making purchasing decisions. By way of nonlimiting the tool engaging region 200 may separate from the tool when 20 or more pounds of force, is applied therebetween.

In some embodiments, such as that illustrated, the tool engaging region 200, including at the deformation region 230 thereof may include a deformation feature 240, such as the notch (e.g., triangularly shaped) in the illustrated embodiment, which may be structurally weaker than the remainder of the tool engaging region 200 behind the surface 210, such that pulling the packaging card 100 relative to the tool with sufficient force (e.g., the 20 or more pounds of force described above) causes a tear or deformation to form between the surface 210 and the deformation feature 240, such that the portion of the movable member (e.g., the rear blade support 160) may pass through the tear or deformation so that the packaging card 100 may be separated from the tool (e.g., after purchase).

Regardless, it may be appreciated that tearing or deformation at the deformation region 230 may include folding or buckling of the deformation region 230 (including folding or buckling of the deformation feature 240 in some embodiments) in a way that bends the surface 210 away from the movable member, so that relative movement between the packaging card 100 and the tool may occur, and that the tool may be separated from the packaging card 100. In various embodiments other configurations of deformation regions 230 or deformation features 240 may be possible, such as but not limited to perforated regions or breakaway regions (e.g., where the deformation region 230 comprises a perforated strip, and each perforation cutout would be a deformation feature 240).

In some embodiments, a portion of the packaging card 100 may remain within the tool when forcibly detached, while in other embodiments the packaging card 100 may be configured to pull the broken away components thereof out of the tool when detached. In some embodiments, a housing of the tool may be opened to disengage the packaging card 100 from the tool following purchase of the tool.

As noted above, it may be appreciated that in some embodiments packaging cards for retractable utility knives may be configured so that the packaging card is coupled to the retractable utility knife after the knife has been fully assembled, so that quality control testing of the fully assembled retractable utility knife can be completed prior to mounting the knife onto the packaging card.

Figure 5:
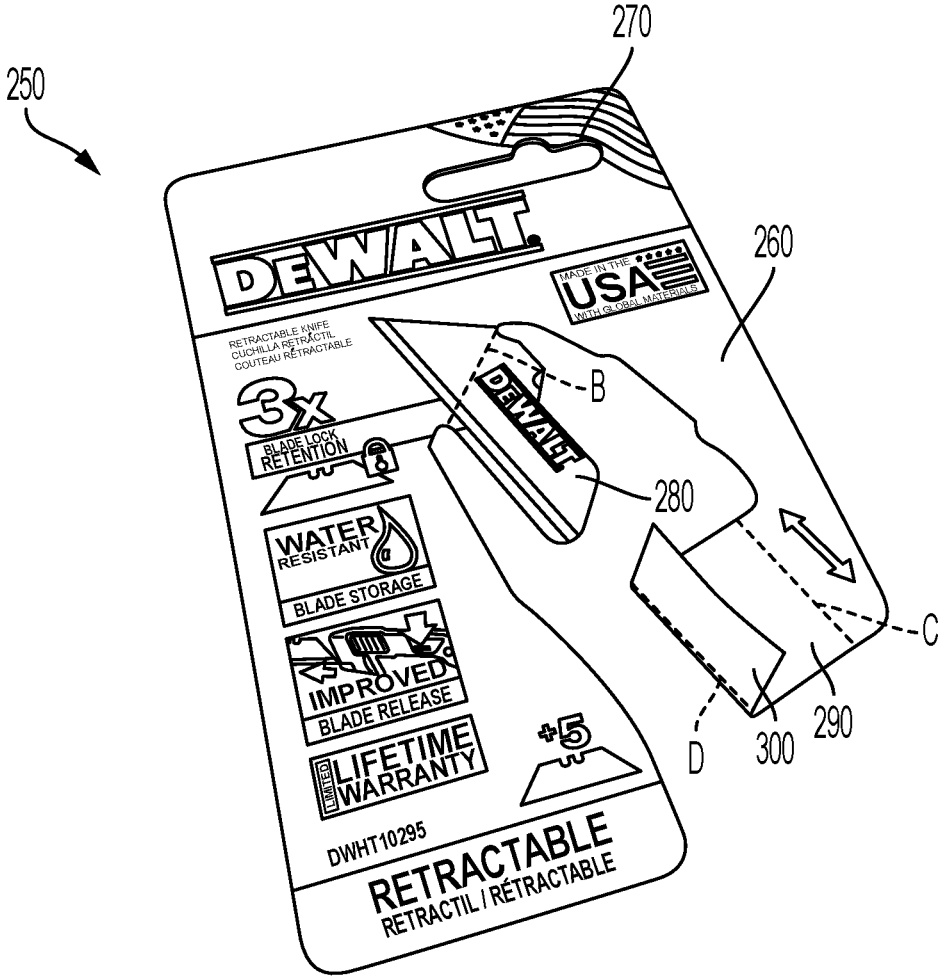
FIG. 5 illustrates a second embodiment of a packaging card configured to be received inside a retractable utility knife after the knife has been fully assembled.

As shown in FIG. 5, in an embodiment a packaging card 250 may include a body 260 that may be generally similar to the body 180 described above. For example, in some embodiments the body 260 may include a hang tag aperture 270 similar to the hang tag aperture 190 as previously described, which may facilitate hanging the packaging card 250 and the tool (e.g., utility knife 110) from a peg board or other point of sale or point of purchase displays. In other embodiments, a hang tag engagement region may be attached (e.g., adhered) to the body 260 so as to protrude outward and facilitate hanging the packaging card 250 and the tool.

As further shown, the body 260 may include a front flange 280 (generally indicated as the region separated from the remainder of the body 260 by the dividing line B) which may be received in a front aperture of the tool (e.g., the blade aperture 135 at the front of utility knife 110). As further shown, the body 260 may also include a side flange 290 (generally indicated as the region separated from the remainder of the body 260 by the dividing line C). It may be appreciated, as described in greater detail below, that the side flange 290 may be configured to be inserted into a side aperture of the tool (e.g., the actuator channel at the top side of the utility knife 110 where the actuator 130 of the slidable blade carriage 140 extends out of the handle 120 of the utility knife 110).

As further shown in FIG. 5, the side flange 290 may include a hook 300 (e.g., a folded tab) which may be created by folding a portion of the side flange 290 against itself at a dividing line D to create a V shaped channel. It may be appreciated that memory or resiliency of the material forming the side flange 290 or of the hook 300 relative to the side flange 290 may cause the hook 300 to extend back away from the side flange 290 after the hook 300 is inserted into a side aperture of the tool. For example, where the tool is the utility knife 110, once the hook 300 is held close to the side flange 290 and inserted into the housing rails of the actuator channel 133 at the top side of the utility knife 110 where the actuator 130 of the slidable blade carriage 140 extends out of the handle 120 of the utility knife 110, the hook 300 may catch on the rails inside the casing of the utility knife 110 adjacent to the actuator channel 133, securing the packaging card 250 to the utility knife 110 so that the utility knife 110 and packaging card 250 can be hung from the hang tag aperture 270, and deterring removal of the packaging card 250 until sufficient force is applied to overcome the holding power of the hook 300 until following purchase.

It may be appreciated that similar engagement features on other tools may allow for assembly of the packaging card 250 onto such tools, leveraging both a front aperture and a side aperture of the tool. In other embodiments, any two apertures in the tool may be leveraged to secure the packaging card 250 onto the tool, such that resiliency, shape memory, or relative rigidity of the packaging card 250 may engage the tool such that force is required to overcome a hook 300 on the packaging card 250 to disengage the packaging card 250 from the tool.

Figure 6:
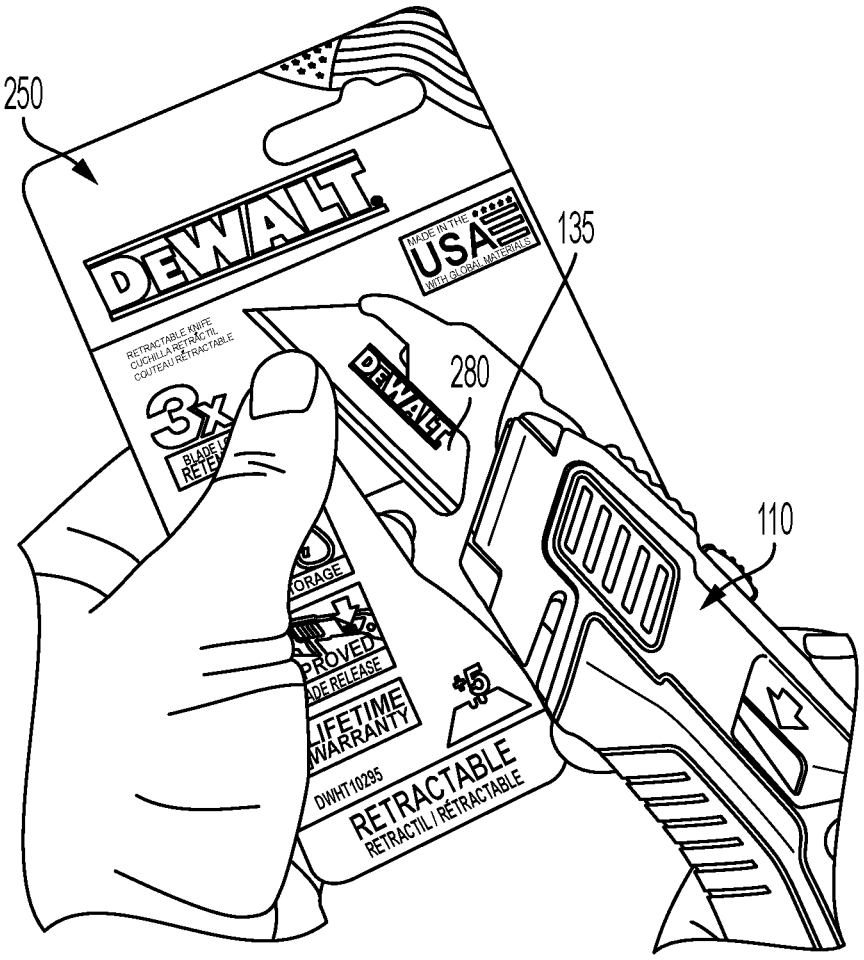
FIG. 6 illustrates a first step in mounting the packaging card to the retractable utility knife, inserting a front flange into a blade opening of the retractable utility knife.
Figure 7:
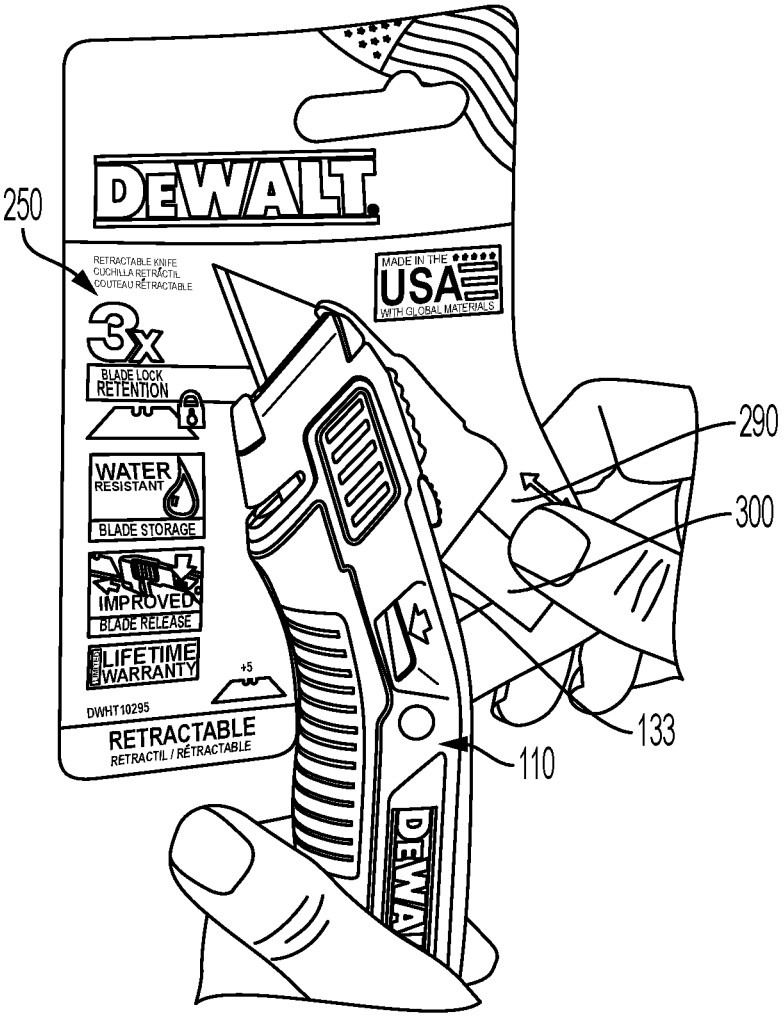
FIG. 7 illustrates a second step in mounting the packaging card to the retractable utility knife, inserting a bendable tab of the card into a channel for the actuator of the slidable blade carriage of the utility knife.
Figure 8:
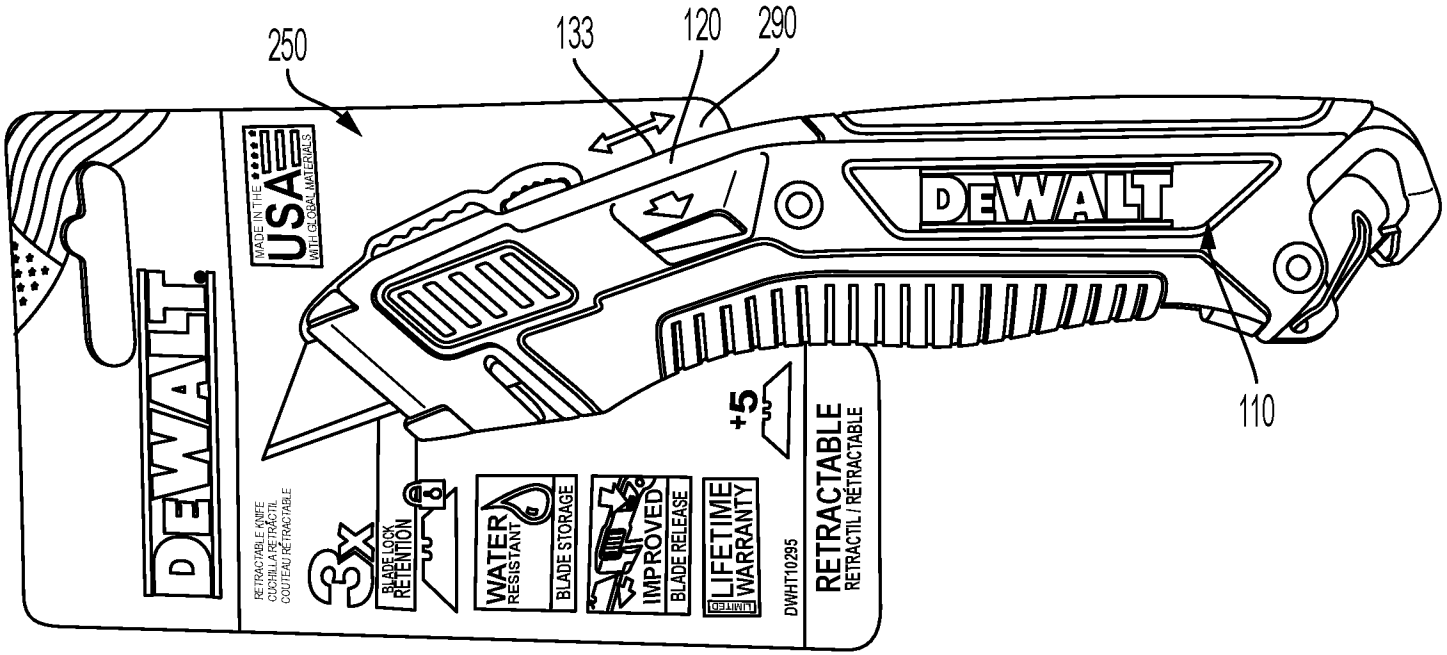
FIG. 8 illustrates the assembled combination of the packaging card of the second embodiment with the retractable utility knife.

FIGS. 6-8 illustrate assembly an embodiment of mounting a utility knife 110 onto the packaging card 250. As shown in FIG. 6, assembly may comprise inserting the front flange 280 of the packaging card 250 into blade aperture 135 of the utility knife 110. It may be appreciated that the side flange 290 of the packaging card 250 may be flexed behind or away from the utility knife 110 as the front flange 280 is inserted into position within the blade aperture 135. Once the front flange 280 is received within the blade aperture 135, as shown in FIG. 7, the packaging card 250 may be flexed so that the side flange 290 can be inserted into the actuator channel 133, and in particular such that the hook 300 may be inserted into the actuator channel 133 in a way such that it would spring or otherwise extend outward away from the side flange 290, hooking onto and catching on the rails inside the casing of the utility knife 110 adjacent to the actuator channel 133, securing the packaging card 250 to the utility knife 110 so that the utility knife 110 and packaging card 250 can be hung from the hang tag aperture 270, and deterring removal of the packaging card 250 until sufficient force is applied to overcome the holding power of the hook 300 until following purchase. Accordingly, FIG. 8 illustrates the utility knife 110 fully assembled onto the packaging card 250.

It may be appreciated that the components described herein may be of different constructions or configurations, including but not limited to one or more being comprised of different material choices. For example, the packaging cards 100 or 250 and the tools mounted thereto may each be constructed from a variety of materials, including but not limited to one or more of fabrics, plastics, metals, rubbers, elastomers, or any other appropriate material choice. For example, portions of the packaging cards 100 and 250 may comprise molded plastic, extruded plastic, paper, metal, or combinations thereof (e.g., a plastic body 180 with a perforated cardstock tool engaging region 200, or a card stock body 250 with a plastic hook 300 secured thereto). In some embodiments, the material choices may differ from component to component. In various embodiments, some components may be integrally formed together, while other components may be assembled by any appropriate mechanism, including but not limited to fastened, welded, glued, snap-fit, or other appropriate securements.

Figure 9:
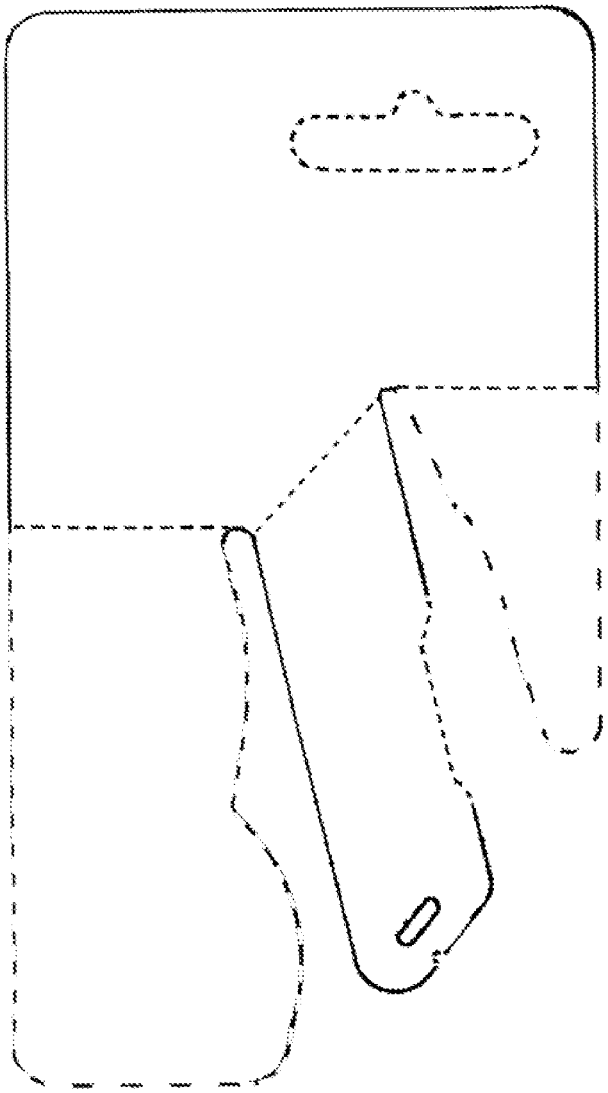
FIG. 9 illustrates an embodiment of an ornamental design of the packaging card of the first embodiment.

Although the utility of the inventions disclosed herein is described above, it may be appreciated that the ornamental appearance of the designs illustrated in the Figures and/or described in the specification may be separately patentable. For example, FIG. 9 illustrates an embodiment of a packaging card similar to the packaging card 100. As depicted thereon, dotted lines indicate various features which may be omitted in some embodiments (e.g., notches and cutouts, which shown initially in dotted line may be included in a claim as amended or pursued in another design application) and/or indicate boundary facets defining regions which may be omitted in some embodiments. For example, in some embodiments only the region corresponding to the tool engaging region 200 of the packaging card 100 may be present as ornamentally depicted, with the remainder of the packaging card disclaimed, while in other embodiments, such feature may be in combination with the upper region of what corresponds to the body 180 (e.g., omitting one or more of the regions extending adjacent to the feature, below the depicted horizontal dotted lines), and in still other embodiments where the hang tag is present (even though it is disclaimed in the drawing as shown in FIG. 9). In various embodiments where, curved transitions from horizontal line to horizontal line are depicted, it may be appreciated that a right angle or alternative radius of curvature may be understood as a de minimis modification that is within the scope of the depicted ornamental appearance. As the packaging card is substantially flat in some embodiments, it may be appreciated that the mirror image of the depicted figure may be the rear view of the packaging card or may be disclaimed in its entirety, while the top, left, right, and bottom views are omitted or disclaimed due to lack of ornamentation.

Although aspects of the invention have been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the exemplary disclosed embodiments. For example, it is to be understood that the present invention contemplates that, to the extent possible, one or more features of any embodiment can be combined with one or more features of any other embodiment.

What is claimed is:

1. A packaging card for a tool, wherein the tool comprises a fixed member and a movable member such that the movable member is selectively movable relative to the fixed member, the packaging card comprising:

a tool engaging region coupling the packaging card to the movable member such that movement of the movable member relative to the fixed member moves the packaging card relative to the fixed member; and a deformation region configured to tear or deform upon application of a separation force sufficient to remove the packaging card from the tool.

2. The packaging card of claim 1, wherein the tool is a retractable utility knife, the fixed member is a handle, and the movable member is a slidable blade carriage.

3. The packaging card of claim 2, wherein the slidable blade carriage comprises a rear blade support, and wherein the deformation region comprises a surface of the packaging card extending behind the rear blade support.

4. The packaging card of claim 3, wherein the surface of the packaging card extending behind the rear blade support is part of an aperture in the tool engaging region that surrounds the rear blade support.

5. The packaging card of claim 4, further comprising a deformation feature configured to promote tearing or deformation of the tool engaging region upon application of the separation force.

6. The packaging card of claim 2, wherein a body of the packaging card extends along one or more of the handle and an actuator of the slidable blade carriage, and are sufficiently flexible to bend away from the retractable utility knife when a user is demonstrating movement of the sliding blade carriage relative to handle.

7. The packaging card of claim 1, wherein the deformation region comprises a surface of the packaging card extending behind a portion of the movable member, distal from where the tool engaging region extends from a body of the packaging card.

8. The packaging card of claim 7, wherein the surface of the packaging card extending behind the portion of the movable member is part of an aperture in the tool engaging region that surrounds the portion of the movable member.

9. The packaging card of claim 8, further comprising a deformation feature configured to promote tearing or deformation of the tool engaging region upon application of the separation force.

10. The packaging card of claim 1, wherein a body of the packaging card extends along one or more of fixed member and an actuator of the movable member, and are sufficiently flexible to bend away from the tool when a user is demonstrating movement of the movable member relative to the fixed member.

11. The packaging card of claim 1, wherein at least the deformation region comprises one or more of paper stock, card stock, cardboard, or plastic.

12. The packaging card of claim 1, wherein the packaging card is formed from a single piece of material.

13. The packaging card of claim 1, further comprising a hang tag.

14. The packaging card of claim 13, wherein the hang tag is formed as an aperture in the packaging card.

* * * * *